73-151
12/17/85 OR 4,558,592 SR

United States Patent [19]
Despax et al.

[11] Patent Number: 4,558,592
[45] Date of Patent: Dec. 17, 1985

[54] APPARATUS FOR ON-SITE ASSESSMENT OF THE EFFECTIVENESS OF A TREATMENT IN THE COURSE OF ITS APPLICATION TO A HYDROCARBON WELL

[75] Inventors: Damien M. Despax; Jean-Francois Brisou, both of Paris; Michel F. Castellani, Longport, all of France

[73] Assignee: Compagnie Francaise des Petroles, France

[21] Appl. No.: 610,153

[22] Filed: May 14, 1984

Related U.S. Application Data

[63] Continuation-in-part of Ser. No. 446,309, Dec. 3, 1982, abandoned.

[30] Foreign Application Priority Data

Dec. 14, 1981 [FR] France ..... 81 23260

[51] Int. Cl.[4] ..... E21B 47/00
[52] U.S. Cl. ..... 73/151; 166/250
[58] Field of Search ..... 166/250, 252; 73/151

[56] References Cited

U.S. PATENT DOCUMENTS

| | | | |
|---|---|---|---|
| 3,451,264 | 6/1969 | Kostar | 166/250 |
| 3,477,526 | 11/1969 | Jones et al. | 73/151 |
| 4,010,642 | 3/1977 | McArthur | 73/151 |
| 4,157,659 | 6/1979 | Murdock | 73/151 |

*Primary Examiner*—Howard A. Birmiel
*Attorney, Agent, or Firm*—Sughrue, Mion, Zinn, Macpeak, and Seas

[57] ABSTRACT

The invention relates to an apparatus enabling assessment in real time of the effectiveness of a treatment of a hydrocarbon well which is being applied by introducing fluids under pressure into an injection line. The apparatus comprises a computing unit provided with connections for connection to pressure and flow pick-ups mounted on the injection line at the surface, and connected to a data acquisition unit receiving data relating to the well, to the petroleum-bearing stratum and to the treatment, and a visual display unit which is controlled by the computing unit and which is adapted to display flow relative to the well bottom pressure.

5 Claims, 4 Drawing Figures

FIG. 1
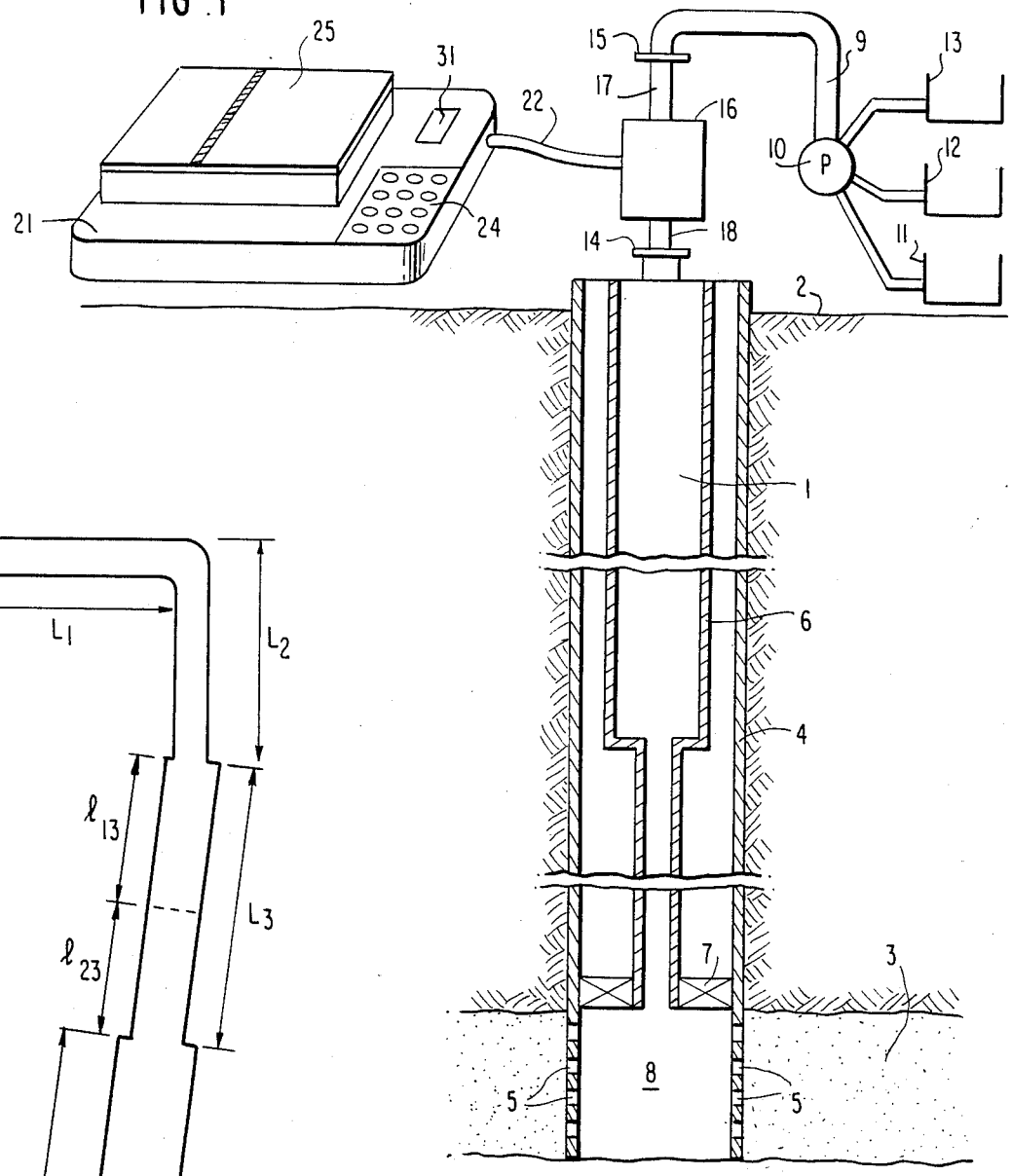
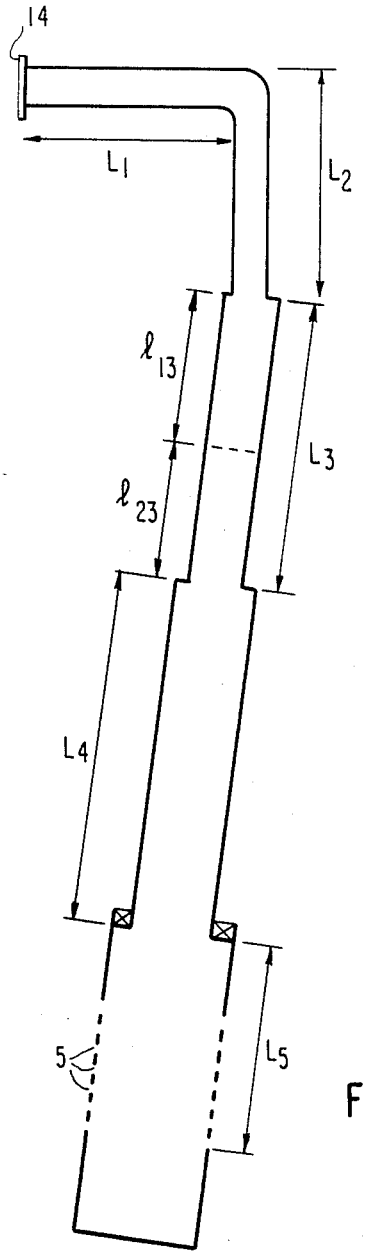
FIG. 4

FIG. 2
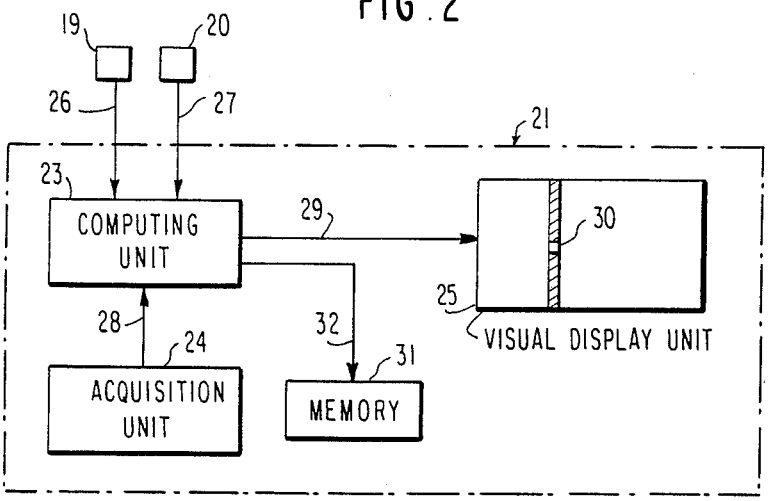
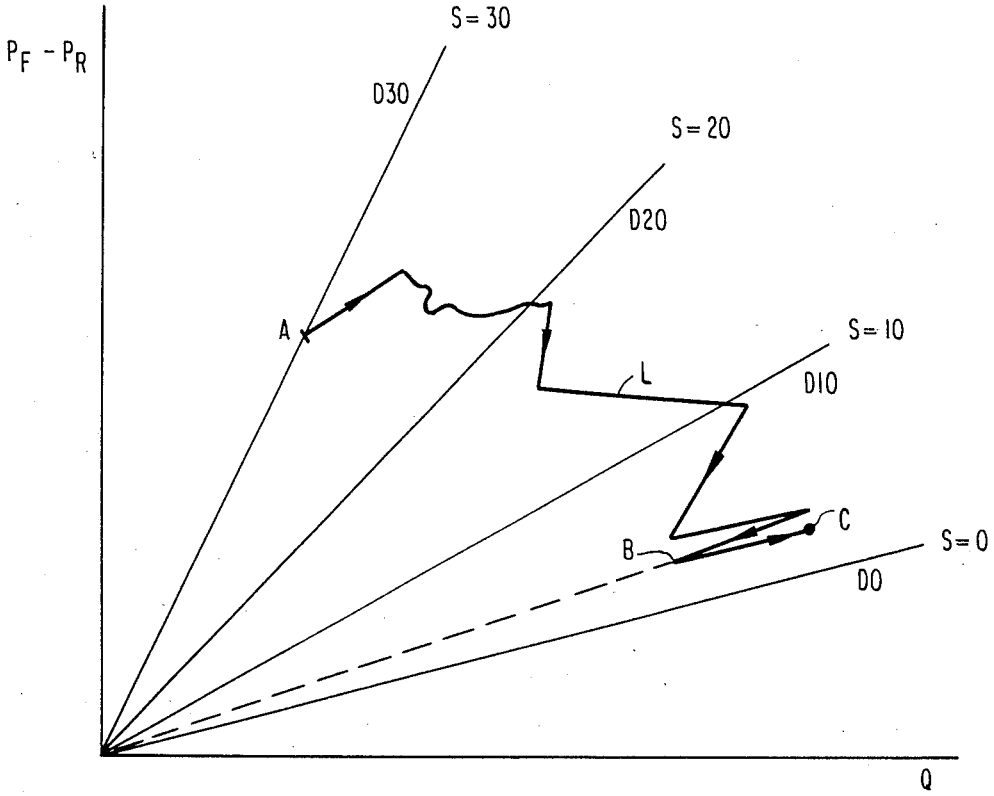
FIG. 3

APPARATUS FOR ON-SITE ASSESSMENT OF THE EFFECTIVENESS OF A TREATMENT IN THE COURSE OF ITS APPLICATION TO A HYDROCARBON WELL

This application is a Continuation-in-Part of application Ser. No. 446,309, filed Dec. 3, 1982, now abandoned.

The invention relates to the assessment of the effectiveness of a treatment applied to a hydrocarbon well. The invention is applicable to various treatments comprising the introduction of fluids under pressure, such as an injection of polymers, or fracturation, but a particularly important application is a treatment, known as acidification, applied for the purpose of reducing skin effect in a well, and in the following description reference will be made more particularly to this last-mentioned application.

It frequently occurs, in fact, that the periphery of a hydrocarbon well (injection well or production well) becomes polluted by various deposits, such as particles of mud, flakes of mobile clay entrained by the flow of effluents, various organic deposits, products of bacterial activity, and so on. This results in clogging, which in most cases gives rise to a considerable reduction of the injection or production capacity of the well.

In order to attempt to restore the well to an ideal condition, suitable treatment known as acidification is applied, which consists in injecting into the stratum, from the well, fluids of different natures in accordance with a precise sequence. These fluids are essentially acids, such as hydrochloric acid, or a mixture of hydrochloric and hydrofluoric acids, heavy oil solvents, and surfactants, etc. Their purpose is to dissolve the deposits preventing the normal flow from the stratum to the well, or from the well to the stratum.

Up to the present time it has not been possible to assess the effectiveness of the treatment applied except a posteriori or approximately, on the basis of phenomena observed on the surface, whereas the weight of the column of fluid in the injection pipe considerably modifies the pressure at the bottom and this modification varies in the course of time when two fluids of different densities are present in this pipe, as always occurs at the commencement of the treament and, very often, subsequently. It would however be very important to be able to follow on the site the effect actually achieved at the bottom of the well by the acidification, while this action is actually taking place, either with a view to stopping the acidification as soon as the desired aim appears to have been achieved (thus saving time and products) or to modify the treatment in the course of its application, or alternatively to gain information for application in other acidification operations.

One object of the invention is an apparatus, which is simple to make and easy to transport and to install, and which makes it possible to assess at any moment the condition of a well undergoing treatment consisting of the introduction of fluids under pressure into an injection line connected at the surface to a pipe extending down to the bottom of the well.

According to the invention there is provided apparatus for on-site assessment of the effectiveness of a treatment during its application to a well whose bottom reaches a stratum of hydrocarbons, by the introduction of fluids under pressure into an injection line connected at the surface to a pipe extending down to the bottom of the well and provided with detector means for detecting information relating to pressure and flow, the apparatus comprising a computing unit, connection means for connecting said computer means to said detector means for receiving said information therefrom, a data acquisition unit adapted for receiving data relating to the well, to the stratum and to the treatment, connection means for connecting said computer unit to said data acquistion unit for receiving said data therefrom, said computing unit being capable of calculating the pressure $P_F$ at the bottom of the well from said information and said data received thereby, a visual display unit, and connection means for connecting said visual display unit to said computing unit for receiving control instructions from said computing unit, said visual display unit being adapted to display at any moment a representative point defined by coordinates related, in the one case, to the pressure $P_F$ at the bottom of the well, as calculated by said computing unit, and, in the other case, to the flow Q in the said injection line, as determined from information from at least one of said detector means.

Preferably the visual display unit is capable of displaying at any moment a representative point, one of the coordinates of which is proportional to the difference in pressure between the pressure at the bottom of the well, calculated by the said computing unit, and the stratum pressure introduced into the said data acquisition system.

The visual display unit may be capable of displaying also at least one line characteristic of the relative variation of the said coordinates for a given value of the skin effect.

An embodiment of the invention will now be described, by way of example only, with reference to the accompanying diagrammatical drawings.

In the drawings:

FIG. 1 shows very diagrammatically a petroleum well undergoing acidification with an embodiment of apparatus according to the invention used for assessing the effectiveness of this treatment;

FIG. 2 is a synoptic diagram of the units of which the embodiment of apparatus according to the invention of FIG. 1 is composed;

FIG. 3 is a diagram showing the curves which can be displayed on the visual display unit; and FIG. 4 is a diagram showing the dimensions used in the calculation of the bottom pressure $P_F$.

In FIG. 1, a petroleum well 1 extends from the surface 2 to an oil-bearing stratum 3. This well is bounded by a casing 4, which is provided with perforations 5 level with the stratum 3. A pipe 6, provided with a sealing device or packer 7, connects the well bottom 8, which is level with the stratum 3, to the surface.

When acidification is to be carried out, use is made of an injection line 9 connected on the one hand to the top of the pipe 6, and on the other hand to a pump 10, in order to introduce into the pipe 6 a succession of treatment fluids taken from various tanks, such as 11, 12 and 13.

A set 16 of pickups is connected in series in the injection line 9 by means of two joints shown diagrammatically at 14 and 15. This set 16 is preferably connected to the injection line 9 by pivot connectors 17,18 of the kind available on the market under the name CHIKSAN. The set 16 comprises at least two pickups 19 and 20, shown diagrammatically in FIG. 2, one of these pickups being a pressure pickup and the other a flow pickup; the latter may optionally be replaced by a volume pickup displaceable in the injection line 9. The set 16 could also comprise three pickups: a flow pickup, a volume pickup, and a pressure pickup. These pickups provide information in the form of electric signals, and this information is transmitted to an acquisition, computing and visual display assembly 21 by means of an electric cable 22.

The assembly 21 comprises a computing unit 23, an aquisition unit 24 provided with a keyboard, and a visual display unit 25 which may be a screen and which is here a plotting table. The computing unit 23 receives through electrical connections 26 and 27, which form the cable 22, the information supplied by the pickups 19 and 20 and, through the electrical connection 28, the data fed into the acquisition unit 24 relating to the well, the oil-bearing stratum, and the treatment, and it transmits to an electrical connection 29 instructions for the displacement of a stylus 30 on the plotting table 25. The construction of these various units is in itself conventional and need not be further explained here.

The computing unit 23, which is preferably a microprocessor, calculates the pressure $P_F$ at the bottom 8 of the well 1 from the head pressure $P_T$, which is measured by one of the pickups 19 and 20, taking into account the loss of head in the pipe 6 and the hydrostatic pressure. This loss of head and this hydrostatic pressure are determined by the computing unit 23 from the information regarding flow which it receives direct from the pickups or which it deduces by derivation from the volume measured by the pickups, in accordance with the information regarding volume which it deduces by integration of the flow measured or which it receives direct from the pickups, and in accordance with the data fed into the acquisition unit 24 with regard to the geometrical description of the pipe 6 and to the density and viscosity of fluids used in succession in the acidification. This results in the obtaining of the pressure $P_F$, which it would be impossible to measure directly in the present state of the art, and the direct measurement of which would be far more expensive than calculation if it should ever become possible.

It is known that the injection flow Q in the injection line 9 is linked to the excess pressure ΔP, by which the pressure $P_F$ at the bottom 8 exceeds the pressure $P_R$ in the stratum 3, by the following relationship:

$$Q = \frac{KH}{141.2\,B\mu} \times \frac{\Delta P}{\ln\left(\frac{R}{Rw}\right) + S}$$

where Q is expressed in barrels per day, H is the thickness of the stratum expressed in feet, $\mu$ is the viscosity of the injected fluid expressed in centipoises, K is the permeability of the stratum, for which the unit used is the millidarcy, ΔP is expressed in pounds per square inch, R is the drainage radius expressed in feet, Rw is the radius of the well expressed in feet, S is the skin coefficient, and B is the coefficient of expansion of the effluent.

In accordance with the orders received through the connections 29, the plotting table 25 shows a representative point, such as the point A (FIG. 3) defined by two coordinates, which are the injection flow Q and the difference in pressure ΔP between the pressure $P_F$ and the pressure $P_R$. It will be observed that an error in $P_R$ or the non-utilisation of $P_R$ would only entail a displacement of the representation.

The above formula shows that it is possible to ascertain the original value of the coefficient S, for example S=30, and to trace the characteristic straight line $D_{30}$ representing ΔP plotted against Q for this value of S. From this value of S it is possible to deduce the ideal characteristic straight line $D_0$ for S=0 and thus also to trace other characteristic straight lines, for example $D_{20}$ for S=20 and $D_{10}$ for S=10. These characteristic straight lines can be traced by the plotting table 25 under the control of the computing unit 23.

In FIG. 3 these various straight lines $D_0$, $D_{10}$, $D_{20}$ and $D_{30}$ have been drawn, together with the line L in accordance with which the representative point can be displaced from its original position A to its final positions B and C in the course of the acidification treatment. In this example it can be seen that from B to C the coefficient S remains the same, which means that the acidification treatment gives no further improvement. As S=0 is then near, the treatment will be stopped. If on the other hand this phenomenon were to occur for a relatively high value of S, the treatment could be modified in order to attempt to obtain a new reduction of S. The lines shown in FIG. 3 demonstrate how easily the proposed apparatus permits the continuous assessment in real time of the effect produced by an acidification treatment, because of the fact that at any moment the operator can see the point reached, the path travelled and the evolution of the results obtained by the treatment.

The apparatus may in addition contain a memory, diagrammatically represented at 31 and connected by a connection 32 to the computing unit 23, this memory effecting mass storage by a magnetic process or by a semiconductor process. The information thus stored, relating to flow, pressure in the injection line, volume and loss of head, for example, enable verifications to be made through a subsequent treatment.

Instead of displaying successive points defined by coordinates ΔP and Q as mentioned above, one could, as well, display Q/ΔP or ΔP/Q as a function of time. Thus, the visual display is capable of displaying at any moment a point defined by the pressure $P_F$ at the bottom of the well and the flow rate Q, without referring to the coordinates used.

Prior determination of the parameters expressing ΔP as a function of S is neither easy nor very accurate but is known (see Earlougher, Jr., "Advances in Well Test Analysis", 1977). Such a determination is made to be sure that the maximum improvement to the well has been obtained: one knows that the acidification treatment gives no further improvement (positions B and C), when one sees that the last points on line L are near the ideal characteristic straight line Do for S=0. If, on the contrary, the points were far from line Do, one could try another treatment.

But, if one does't intend to try another treatment and only wishes to know at what time to stop the present treatment, one has no need of straight lines D for determined values of S. One has only to look at the points reached on line L. When one sees that the last points on line L correspond to the same ratio ΔP/Q, i.e. are located on a same straight line D, one knows that the treatment has produced its full effect.

So even if one does't know the values of the parameters in the expression of ΔP, one can use the apparatus, the essential conclusion drawn from the expression being the proportional relationship between ΔP/Q and S.

Determination of the values of the parameters may be made by known methods which are not part of the present invention. If such a determination is carried out, the result thereof is used in the apparatus to draw at least one line D for a given value of S and to have a better assessment of the effectiveness of the treatment relative to the ideal improvement.

METHOD FOR CALCULATING $P_F$

The formula used is well known:

$$P_F = P_T + P_H - P_L$$

where $P_F$: the bottom pressure, $P_T$: the head pressure which is directly measured, $P_H$: hydrostatic head of the liquid column in the injection tubing, $P_L$: loss head in this column.

In the formula, $P_H$ and $P_L$ are calculated as sums of elementary values individually calculated for each of a plurality of successive tube portions into which the injection tubing is divided for a calculation purpose, a same tube portion having constant transverse section and slant and containing one liquid.

For example, on FIG. 4 an injection tubing, schematically shown from joint 14 to perforations 5, comprises:

- a horizontal portion of length $L_1$, diameter $D_1$ and inclination angle relative to the vertical $\alpha l$ ($\alpha l = 90°$),
- a vertical portion of length $L_2$, diameter $D_2$ and inclination angle $\alpha 2$ ($\alpha 2 = 0°$),
- a slanting portion of length $L_3$, diameter $D_3$ and inclination angle $\alpha 3$,
- a slanting portion of length $L_4$, diameter $d_4$ and inclination angle $\alpha 4$,
- a slanting portion of length $L_5$, diameter $D_5$ and inclination angle $\alpha 5$.

Some of tube portions $L_1$ et $L_5$ may have to be divided into two tube portions such as $l_{13}$ and $l_{23}$ by the computer unit if separation surface between two injection liquids is located in such tube portions.

$P_H$ and $P_L$ are given by the following formulae:

$$- P_H = \Sigma g\, Li \times di \cos \alpha i \quad (di = \text{liquid density})$$

$$- P_L = \lambda \Sigma \frac{Li \times di^2 \times Q^2}{Di^5}$$

where $\lambda$ is a coefficient calculated or determined by prior test.

For example, at the beginning, the injection tubing is full of reservoir oil and we intend to successively inject:

a solvent,

HCl 15%, $NH_4Cl$ (spacer),

HCl 12%+HF 3%, diesel fuel oil (thrust liquid).

First, geometrical data of the injection tubing are introduced into the computer unit: $L_1$ to $L_5$, $D_1$ to $D_5$, $\alpha_1$ to $\alpha_5$ as well as densities of the initial liquid and of the various injection liquids intended to be injected. Then, information is given to the computer unit that injection liquid $N_oi$ is now injected so that the computer unit which knows the flow rate Q can determine at any time where the separation surface between injection liquid $N_oi$ and the preceding liquid is located. At each change in injection liquids the computer unit is informed that injection of liquid X is stopped and that injection of liquid Y is started. If, at a given time, the computer unit determines that there are two liquids in the injection tubing and that the separation surface is located in the tube portion of length $L_3$ as shown in FIG. 4 the computer unit replaces in the formula of $P_H$, $L_3 \times d_3$ by: $(\mathbf{1}_{13} \times d_{13} + \mathbf{1}_{23} \times d_{23})$ and in the formula of $P_L$, $L_3 \times D_3^2$by: $(\mathbf{1}_{13} \times d_{13}^2 + \mathbf{1}_{23} \times d_{23}^2)$. so at any time, the computer unit gives $P_H$ and $P_L$ and therefore $P_F$.

The proposed apparatus can be housed in a valise type case which is easily transportable and very quickly installed on a worksite, because it is sufficient to connect it to pickups mounted on an injection line.

Numerous variants can obviously be adopted in the constuction and presentation of the apparatus, without departing from the scope of the invention.

What is claimed is:

1. Apparatus for on-site assessment of the effectiveness of a treatment during its application to a well whose bottom reaches a stratum of hydrocarbons, by the introduction of fluids under pressure into an injection line connected at the surface to a pipe extending down to the bottom of the well and provided with detector means for detecting information relating to pressure and flow, the apparatus comprising a computing unit, connection means for connecting said computing unit to said detector means for receiving said information therefrom, a data acquisition unit adapted for receiving data relating to the well, to the stratum and to the treatment, connection means for connecting said computer unit to said data acquisition unit for receiving said data therefrom, said computing unit being capable of calculating the pressure $P_F$ at the bottom of the well from said information and said data received thereby, a visual display unit, and connection means for connecting said visual display unit to said computing unit for receiving control instructions from said computing unit, said visual display unit being adapted to display at any moment a representative point defined by the pressure $P_F$ at the bottom of the well, as calculated by said computing unit, and the flow Q in said injection line, as determined from information from at least one of said detector means.

2. Apparatus according to claim 1, wherein said visual display unit is adapted to display at any moment a representative point, one of the coordinates of which is proportional to the difference in pressure between the pressure ($P_F$) at the bottom of the well, calculated by said computing unit, and the pressure ($P_R$) of the stratum introduced into the data acquisition unit.

3. Apparatus according to claim 1, wherein said visual display unit is adapted to display at least one line which is characteristic of the relative variation of the said coordinates for a given value of the skin effect.

4. Apparatus according to class 2, wherein said visual display unit is also adapted to display at least one line which is characteristic of the relative variation of the said coordinates for a given value of the skin effect.

5. Apparatus according to claim 1 wherein said representative point is defined by coordinates related, in the one case, to the pressure $P_F$ at the bottom of the well, as calculated by said computing unit, and, in the other case to the flow Q in said injection line as determined from information from at least one of said detector means.

* * * * *